US010077168B2

(12) United States Patent
Eicher et al.

(10) Patent No.: US 10,077,168 B2
(45) Date of Patent: Sep. 18, 2018

(54) AUTOMATIC LEVELING DEVICE WITH ADJUSTABLE ORIENTATION SETTING

(71) Applicants: Thomas R. Eicher, Rockton, IL (US); Skyler D. Halcom, Loves Park, IL (US); David L. Ewald, Stillman Valley, IL (US)

(72) Inventors: Thomas R. Eicher, Rockton, IL (US); Skyler D. Halcom, Loves Park, IL (US); David L. Ewald, Stillman Valley, IL (US)

(73) Assignee: The Caldwell Group, Inc., Rockford, IL (US)

( * ) Notice: Subject to any disclaimer, the term of this patent is extended or adjusted under 35 U.S.C. 154(b) by 547 days.

(21) Appl. No.: 14/271,634

(22) Filed: May 7, 2014

(65) Prior Publication Data

US 2015/0321886 A1 Nov. 12, 2015

(51) Int. Cl.
*B66C 1/10* (2006.01)

(52) U.S. Cl.
CPC ..... *B66C 1/10* (2013.01)

(58) Field of Classification Search
CPC ..... B66C 1/10
USPC ..... 294/67.1, 67.5, 81.3, 81.4
See application file for complete search history.

(56) References Cited

U.S. PATENT DOCUMENTS 3,596,968 A * 8/1971 Holm ..... B66C 1/10 294/81.3
4,245,941 A * 1/1981 Charonnat ..... B66C 1/101 294/67.21
4,422,683 A * 12/1983 Charonnat ..... G01C 9/10 294/81.3
4,487,741 A * 12/1984 Vuckovich ..... B66C 13/105 212/278
4,648,647 A * 3/1987 Patton ..... B66C 1/105 212/195
4,759,674 A * 7/1988 Schroder ..... B25J 18/02 248/123.2
4,936,616 A * 6/1990 Williams ..... B66C 1/10 294/67.5
6,718,229 B1 * 4/2004 Takebayashi ..... B25J 9/1687 414/749.1
7,455,338 B2 11/2008 Jenney
7,931,320 B2 * 4/2011 Alway ..... B66C 1/10 294/67.5
8,000,835 B2 * 8/2011 Friz ..... B66C 13/04 294/67.5
2007/0080549 A1 * 4/2007 Jenney ..... B66C 1/10 294/81.3
2011/0036043 A1 * 2/2011 Heinaman ..... B66C 1/105 52/741.1

* cited by examiner

*Primary Examiner* — Paul T Chin
(74) *Attorney, Agent, or Firm* — Reinhart Boerner Van Deuren P.C.

(57) ABSTRACT

An automatic leveling device includes a motor mounted onto a frame, a linear actuator coupled to the motor, and a slideable bail assembly coupled to the linear actuator. The bail assembly is attached to the frame. The frame is configured to attach to a lifting beam, which is attached to a load surface. A controller assembly has a sensor configured to determine an orientation of the load surface when the load is suspended. The controller assembly is configured to automatically control the motor in order to position the slideable bail assembly such that the load is suspended in a predetermined orientation.

26 Claims, 4 Drawing Sheets

AUTOMATIC LEVELING DEVICE WITH ADJUSTABLE ORIENTATION SETTING

FIELD OF THE INVENTION

This invention generally relates to an automatic leveling device.

BACKGROUND OF THE INVENTION

In industrial and construction settings, cranes are frequently used to lift and transport heavy loads. However, it is not unusual for this to be a time-consuming process as great care must be taken to properly balance the load before lifting. Furthermore, it is possible, in some instances, that some of the weight in the load may shift during transport causing a load imbalance. Depending on the severity of the imbalance, the load may shift in a way that presents safety issues for nearby workers. Accordingly, there is a need for a device that avoids the aforementioned problems associated with the lifting and transport of heavy loads using a crane.

Embodiments of the invention provide such a device. These and other advantages of the invention, as well as additional inventive features, will be apparent from the description of the invention provided herein.

BRIEF SUMMARY OF THE INVENTION

In one aspect, embodiments of the invention provide an automatic leveling device that includes a motor, a linear actuator coupled to the motor, and a slideable bail assembly coupled to the linear actuator. The bail assembly is configured to attach to a frame. A controller assembly has a sensor configured to determine an orientation of an attached load when the load is suspended. The controller assembly is configured to automatically control the motor in order to position the slideable bail assembly such that the load is suspended in a predetermined orientation.

In a particular embodiment of the invention, the bail assembly and frame are attached to a lifting beam which is attached to a surface of the load, and the controller assembly is configured to automatically position the bail assembly to keep the surface of the load in a horizontal orientation while the load is suspended. In another embodiment, the bail assembly and frame are attached to the lifting beam which is attached to a surface of the load, and the controller assembly is configured to automatically position the bail assembly to keep the surface of the load oriented at a predetermined angle with respect to horizontal while the load is suspended. It is envisioned that a wide variety of lifting beams are suitable for attachment to the bail assembly and frame. In certain embodiments, the bail assembly includes a device configured to receive a lifting hook of a crane.

The controller assembly may be configured to be powered by an AC power source, or, alternatively, it may be configured to be powered by a DC power source. In a particular embodiment, the DC power source is a battery configured to supply a voltage between 12 volts and 32 volts. However, the invention is not intended to be limited by this voltage range.

In a particular embodiment, the controller assembly includes control circuitry which uses relay logic. In an alternate embodiment, the controller assembly includes control circuitry which uses programmable logic controllers (PLCs). Furthermore, in some embodiments, the sensor is an inclination sensor. In at least one embodiment, the controller assembly includes a plurality of inclination sensors arranged to detect a first inclination about a first rotational axis and a second inclination about a second rotational axis, the first rotational axis being perpendicular to the second rotational axis.

In certain embodiments, the controller assembly includes control features that allow the user to set an angular range for the inclination sensor specifying a desired orientation for the surface of the load such that, when the inclination sensor detects an inclination of the load surface outside of the set angular range, the controller assembly automatically changes the position of the bail assembly to bring the orientation of the load surface to within the set angular range. In a more particular embodiment, the controller assembly is configured to allow the user to specify a first angular range for a first desired orientation and to specify a second angular range for a second desired orientation, wherein the first desired orientation is defined by inclination in a first direction about a rotational axis, and the second desired orientation is defined by inclination in a second direction about the rotational axis, the second direction being opposite the first direction.

In a particular embodiment, after the inclination sensor detects an inclination of the load surface outside of the set angular range, the controller assembly is configured to wait for a predetermined time period before automatically causing a change in the position of the bail assembly. In a more particular embodiment, the predetermined time period is from five milliseconds to ten seconds.

In another aspect, embodiments of the invention provide a load-lifting apparatus that includes a lifting beam configured to be attached to a load, and an automatic leveling device attached to the lifting beam. The automatic leveling device includes a motor, a linear actuator coupled to the motor, and a slideable bail assembly coupled to the linear actuator, the bail assembly configured to attach to a frame. A controller assembly has a sensor configured to determine an orientation of the attached load when the load is suspended. The controller assembly is configured to automatically control the motor in order to position the slideable bail assembly such that the load is suspended in a predetermined orientation.

In a particular embodiment, the bail assembly includes a device configured to receive a lifting hook of a crane. The bail assembly and frame are attached to a lifting beam, which is attached to a surface of the load, and the controller assembly is configured to automatically position the bail assembly to keep the surface of the load oriented at a predetermined angle with respect to horizontal while the load is suspended.

In certain embodiments, the controller assembly includes control features that allow the user to set an angular range for the sensor specifying a desired inclination for the surface of the load. When the sensor detects an inclination of the load surface outside of the set angular range, the controller assembly automatically changes the position of the bail assembly to bring the inclination of the load surface to within the set angular range. The controller assembly may also be configured to allow the user to specify a first angular range for a first desired orientation and to specify a second angular range, independent of the first angular range, for a second desired orientation. The first desired orientation is defined by inclination in a first direction about a rotational axis, and the second desired orientation is defined by inclination in a second direction about the rotational axis, and the second direction is opposite the first direction.

In some embodiments, after the sensor detects an inclination of the load surface outside of the set angular range, the controller assembly is configured to wait for a predetermined time period before automatically causing a change in the position of the bail assembly. The load-lifting apparatus may further include one of a visual alarm and an audible alarm to indicate to the user whether or not the surface of the load is within the set angular range.

In at least one embodiment, the controller assembly includes a plurality of sensors arranged to detect a first inclination about a first rotational axis and a second inclination about a second rotational axis, the first rotational axis being perpendicular to the second rotational axis. The aforementioned lifting beam may be one of a cylinder lifting beam, a twin hoist lifting beam, an adjustable lifting beam, a spreader beam, a four-point beam, and a basket sling beam.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
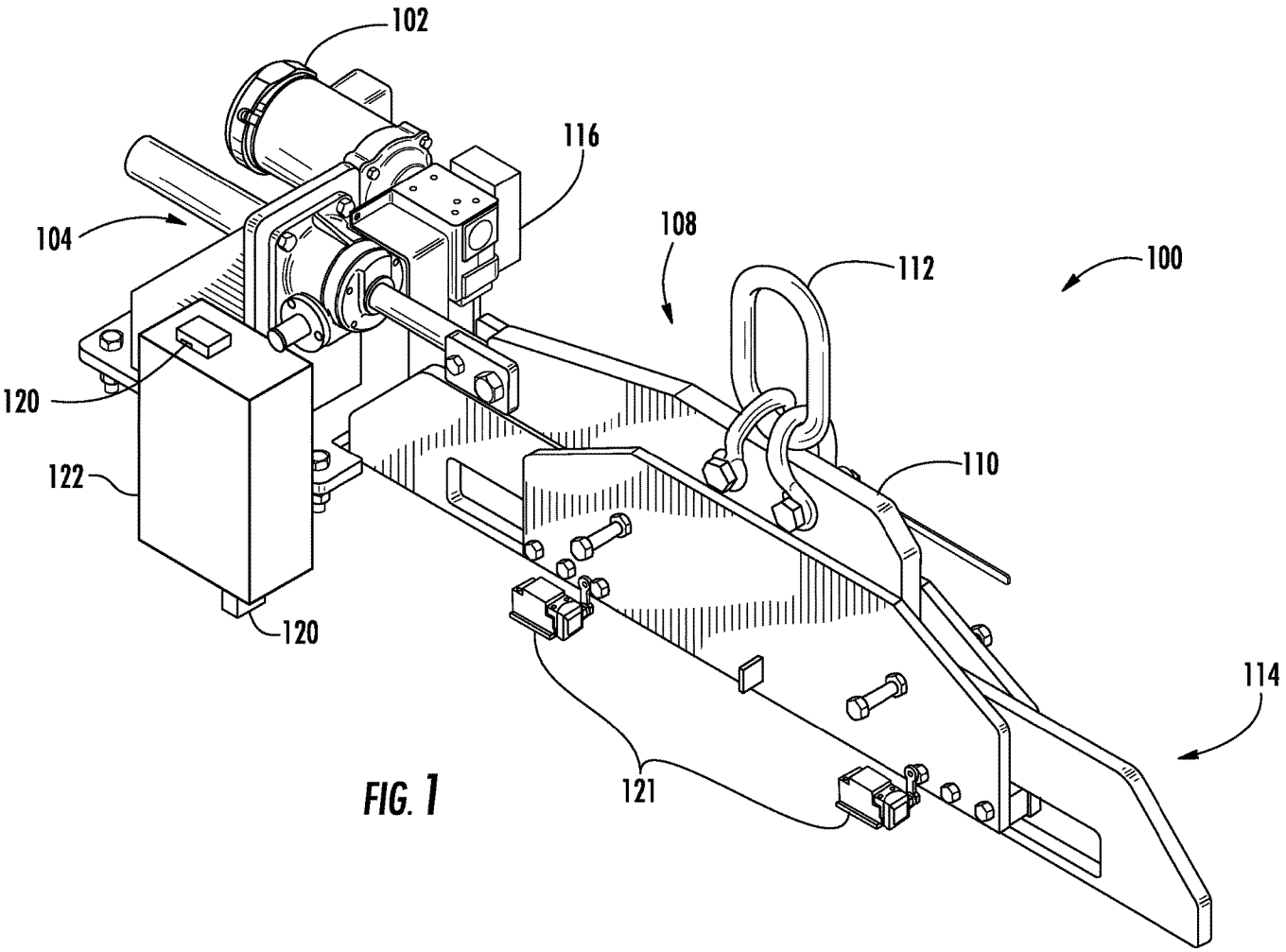
FIG. 1 is a perspective view of an automatic leveling device, according to an embodiment of the invention.
Figure 2:
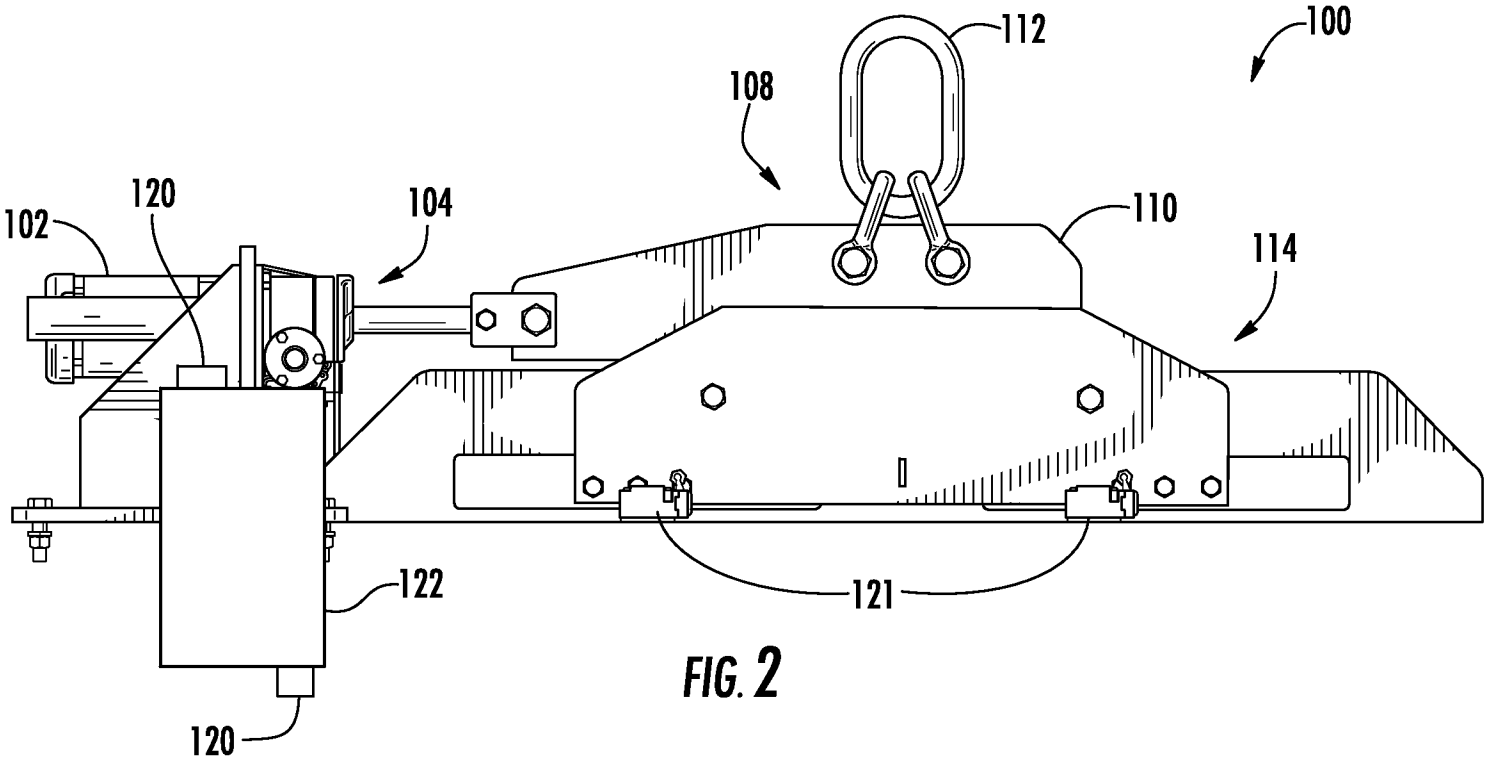
FIG. 2 is a plan view of the automatic leveling device of FIG. 1.

FIGS. 1 and 2 show, respectively, a perspective view and a plan view of an automatic leveling device 100, constructed in accordance with an embodiment of the invention. The automatic leveling device 100 has a motor 102, mounted onto a frame 114, and coupled to a linear actuator 104. In the embodiment shown, the motor 102 is an electric motor, more specifically a three-phase electric motor. However, the invention is not limited to any specific type of motor. For example, a single phase motor could be used. A control enclosure 116 is attached to the frame 114. The control enclosure 116 may include motor control circuitry, various relays, terminal blocks, transformers, current monitors, fuses, and the like.

The motor 102 operates the linear actuator 104 linearly to move a bail assembly 108 back and forth. The linear actuator 104 is coupled to the bail assembly 108 via a shaft, such that the bail assembly 108 moves back and forth based on how the motor operates the linear actuator 104. The bail assembly 108 includes a plate 110 and a ring 112. In the embodiment of FIGS. 1 and 2, the ring 112 is attached to the plate 110 by two looped members attached to the plate 110. The ring 112 is configured to receive an attachment mechanism of a lifting and transport device, such as the hook of a lifting crane for example.

The bail assembly 108 slides along the top of the frame assembly 114, which is configured to attach to a lifting beam, which is attached to the surface of a load (not shown) to be lifted and transported by a device such as the aforementioned lifting crane (not shown). The invention is not intended to be limited to any particular type of lifting beam. The types of lifting beam contemplated for use with embodiments of the invention include, but are not limited to, a cylinder lifting beam, a twin hoist lifting beam, an adjustable lifting beam, a spreader beam, a four-point beam, a rotating drum lifting beam, and a basket sling beam.

The automatic leveling device 100 has an auto-leveling controller 122 configured to automatically position the bail assembly 108 to keep the surface of the load in a horizontal orientation while the load is suspended. The auto-leveling controller 122 may be constructed such that certain parameters may be entered by the user. For example, in a typical embodiment, the auto-leveling controller 122 is configured to automatically position the bail assembly 108 to keep the surface of the load in a horizontal orientation while the load is suspended. However, in certain embodiments, the auto-leveling controller 122 is configured to automatically position the bail assembly 108 to keep the surface of the load oriented at a predetermined angle with respect to horizontal while the load is suspended.

The auto-leveling controller 122 accomplishes the automatic positioning of the bail assembly 108 via one or more inclination sensors 120. The embodiments of FIGS. 1 and 2 show an automatic leveling device 100 with two inclination sensors 120. However, alternate embodiments of the invention may have one inclination sensor 120, or more than two inclination sensors 120. Having two or more inclination sensors 120, arranged to measure inclines for the same rotational axis, may provide redundancy should one of the sensors 120 malfunction. Alternatively, the measurements of multiple inclination sensors 120 could be averaged to potentially reduce the amount of error in any one measurement.

FIGS. 1 and 2 also show an embodiment of the automatic leveling device 100 with two overtravel limit switches 121 attached to the frame assembly 114. The overtravel limit switches 121 operate to prevent the bail assembly 108 from moving too far towards or away from the linear actuator 104. In the event that the bail assembly 108 does move too far towards or away from the linear actuator 104, the limit switch 121 operates to temporarily disable, or limit movement of, the linear actuator 104 until reason for the overtravel is corrected.

As shown in FIGS. 1 and 2, the inclination sensors 120, while connected, either wired or wirelessly, to the auto-leveling controller 122, may be positioned remotely from portions of the auto-leveling controller 122. In the embodiments shown, the inclination sensors 120 are attached to an enclosure of the auto-leveling controller 122, though the inclination sensors 120 could be located in an number of different locations. In specific embodiments, the auto-leveling controller 122 may include switches, buttons, or other suitable control features that allow the user to set an angular range for the inclination sensor 120 specifying a desired inclination for the surface of the load, and wherein, when the inclination sensor 120 detects an inclination of the load surface outside of the set angular range, the auto-leveling controller 122 automatically changes the position of the bail assembly 108 to bring the inclination of the load surface to within the set angular range. In a particular embodiment, the angular range is set in degrees, though other units of angular measurement may be used. Visual indicators, such as red and green lights could be used to show whether the suspended load is in or out of the predetermined angular range set by the user. Audible alarms may also be used for this purpose.

In a particular embodiment, the auto-leveling controller 122 is configured such that, after the inclination sensor 120 detects an inclination of the load surface outside of the set angular range, the auto-leveling controller 122 waits for a predetermined time period before automatically causing a change in the position of the bail assembly 108. In a specific embodiment, the predetermined time period is from five milliseconds to ten seconds, though alternate embodiments include shorter and longer time periods. The auto-leveling controller 122 can be configured to be powered by an alternating current (AC) power source, or a direct current (DC) power source. In a particular embodiment, the controller assembly is powered by a battery configured to supply between 12 and 32 volts.

Figure 3:
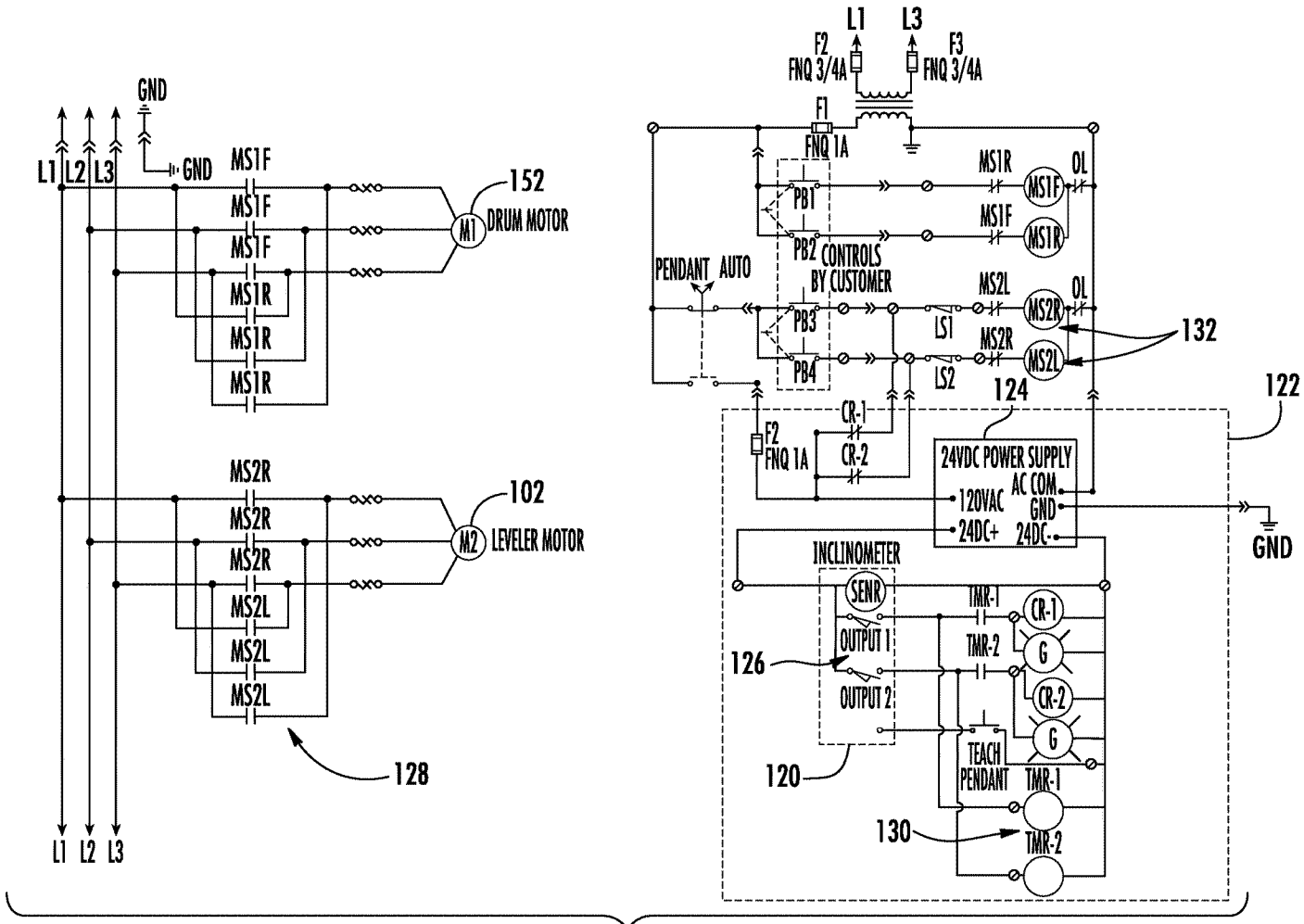
FIG. 3 is a schematic diagram for circuitry in the auto-leveling controller and in the control enclosure, in accordance with an embodiment of the invention.

The control circuitry for the auto-leveling controller 122 could be implemented using relay logic or using programmable logic controllers (PLCs). FIG. 3 shows a schematic diagram of the circuitry for elements of the auto-leveling controller 122 and for the control enclosure 116, according to an embodiment of the invention. The auto-leveling controller 122 is shown inside the dashed square on the diagram of FIG. 3, and includes inclination sensor 120 and a 24-volt DC power supply 124, in this case, fed by a 120-volt AC power source.

In operation, the inclination sensors 120 may mounted on the inside or outside of the enclosure for the auto-leveling controller 122 attached to the frame assembly 114, which is attached to a lifting beam, which is attached to a surface of the load. In the drawings provided, the inclinations sensors 120 are shown as attached to an exterior portion of the enclosure for the auto-leveling controller 122, but the inclination sensors 120 could be located on the inside of the enclosure for the auto-leveling controller 122 along with relays and other electronic components of the automatic leveling device 100. Additionally, embodiments of the invention include those where the inclination sensors 120 are located remotely from the control enclosure 116 and from the auto-leveling controller 122, for example on various parts of the frame 114. Remotely located inclination sensors 120 could have a wired or wireless connection to the auto-leveling controller 122. Each inclination sensor 120 is designed to detect and measure a change in inclination about one rotational axis. The embodiment of FIGS. 1 and 2 shows an automatic leveling device 100 with two inclination sensors 120 both oriented in the same direction, and both arranged to detect and measure changes in inclination about the same rotational axis. When the load is suspended and the inclination sensors 120 sense that the inclination of the surface is outside of the angular range set by the user, one of at least two sensor switches 126 in the inclination sensor 120 is activated.

In an alternate embodiment, an inclination sensor 120 may have four or more switches 126 to allow the sensor 120 to detect and measure inclination about two rotational axes, the first rotational axis perpendicular to the second rotational axis. Alternately, two inclination sensors 120 (or some plurality of sensors 120) arranged perpendicularly to one another could be used to detect and measure inclination about two perpendicular rotational axes. In such an embodiment, the frame 114 of FIG. 1 could be configured to allow for movement of the bail assembly 108 in two dimensions, with four inclination sensors 120 appropriately distributed about the surface of the load. Such an arrangement could also involve two motors 102 and two linear actuators 104 to move the bail assembly 108 in two dimensions. However, in these alternate embodiments, the auto-leveling controller 122 would not substantially depart from the schematic representation of FIG. 3.

Activation of one of the sensor switches 126 operates to close one of the two sets of three relay contacts 128 via which power is supplied to the motor 102. One set of the three relay contacts 128, when closed, causes the motor 102 to operate the linear actuator 104 to move the bail assembly 108 towards the motor 102, while the other set of the three relay contacts 128, when closed, causes the motor 102 to operate the linear actuator 104 to move the bail assembly 108 away from the motor 102. In the embodiment of FIG. 3, when any one of the sensor switches 126 is closes, a corresponding timer relay 130 is activated. Depending on the delay time set by the user, the timer relay 130 will delay activation of the motor relay 132 that activates the relay contacts 128 for the motor 102.

It is envisioned that the auto-leveling controller 122 would be programmable, and configured to accept independent angular ranges for difference orientations. The auto-leveling controller 122 may be configured to allow the user to specify a first angular range for a first desired orientation, or inclination, and to specify a second angular range for a second desired orientation or inclination. For example, one end of a suspended load surface may be allowed to dip one degree below horizontal in the first desired orientation, but allowed to rise three degrees above horizontal in the second desired orientation, before the auto-leveling controller 122 automatically repositions the bail assembly 108 to bring the load surface back within the predetermined angular range.

Figure 4:
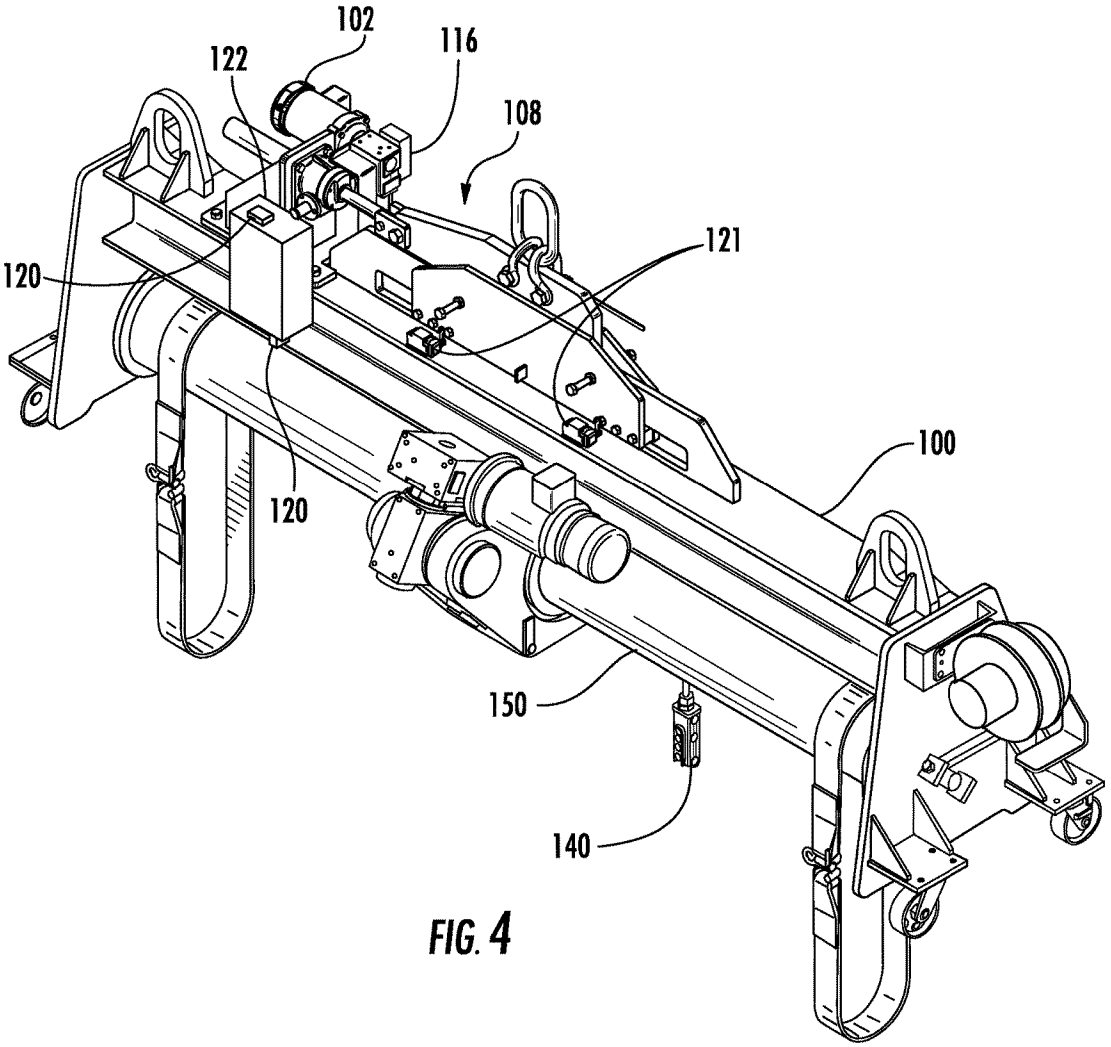
FIG. 4 is a perspective view of the automatic leveling device attached to a rotating drum lifting beam, according to an embodiment of the invention.

FIG. 4 shows a perspective view of the automatic leveling device 100 attached to a rotating drum lifting beam 150, according to an embodiment of the invention. A lifting beam is a structural member designed to be attached to a load to facilitate the lifting and transport of the load, for example via some type of crane. While FIG. 4 depicts rotating drum lifting beam 150, the automatic leveling device 100 could be configured to attach to a wide variety of different lifting beam types. These lifting beams could include, but are not necessarily limited to, various types of cylinder lifting beams, twin hoist lifting beams, adjustable lifting beams, spreader beams, four-point beams, basket sling beams, etc.

A manual pendant 140 allows the user to exert manual control over the automatic leveling device 100, or to set, reset, or delete angular ranges of inclination in the auto-leveling controller 122. The manual pendant 140 may include switches, buttons, or other suitable control features that allow the user to set the angular range for the inclination sensor 120 specifying a desired inclination for the surface of the load, for example, in degrees, or other suitable units of angular measurement. As can be seen from FIG. 3, the auto-leveling controller 122 is connected to the leveler motor 102. Power to the leveler motor 102 is common with power to the drum motor 152 for the rotating drum lifting beam 150. Operation of the drum motor 152 may also be controlled by the user using the manual pendant 140. While the manual pendant 140 shown in FIG. 4 is wired, a wireless pendant could also be used. In a wired configuration, the manual pendant 140 may be wired to the auto-leveling controller 122, or to the control enclosure 116. In an alternate embodiment, the automatic leveling device 100 could be controlled via a control interface on the unit itself rather than remotely using the manual pendant 140.

While the rotating drum lifting beam 150, or any suitable lifting beam, could be manufactured to include the automatic leveling device 100, it is also envisioned that the automatic leveling device 100 could be designed to be retrofitted to existing lifting beams.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An automatic leveling device comprising:

a motor mounted onto a frame;

a linear actuator coupled to the motor;

a slideable bail assembly coupled to the linear actuator, the bail assembly being attached to the frame; and a controller assembly having a sensor configured to determine an orientation of an attached load when the load is suspended, the controller assembly being configured to automatically control the motor in order to position the slideable bail assembly such that the load is suspended in a user-defined predetermined orientation;

wherein the user-defined predetermined orientation may be at horizontal or at some angle with respect to horizontal.

2. The automatic leveling device of claim 1, wherein the frame is configured to attach to a lifting beam, which is attached to a surface of the load, and the controller assembly is configured to automatically position the bail assembly to keep the surface of the load in a horizontal orientation while the load is suspended.

3. The automatic leveling device of claim 1, wherein the frame is configured to attach to a lifting beam, which is attached to a surface of the load, and the controller assembly is configured to automatically position the bail assembly to keep the surface of the load oriented at a predetermined angle, with respect to horizontal, while the load is suspended.

4. The automatic leveling device of claim 3, wherein the lifting beam is one of a cylinder lifting beam, a twin hoist lifting beam, an adjustable lifting beam, a spreader beam, a rotating drum lifting beam, a four-point beam, and a basket sling beam.

5. The automatic leveling device of claim 1, wherein the bail assembly includes a device configured to receive a lifting hook of a crane.

6. The automatic leveling device of claim 1, wherein the controller assembly is configured to be powered by an AC power source.

7. The automatic leveling device of claim 1, wherein the controller assembly is configured to be powered by a DC power source.

8. The automatic leveling device of claim 7, wherein the DC power source is a battery configured to supply a voltage between 12 volts and 32 volts.

9. The automatic leveling device of claim 1, wherein the controller assembly includes control circuitry which uses relay logic.

10. The automatic leveling device of claim 1, wherein the controller assembly includes control circuitry which uses programmable logic controllers (PLCs).

11. The automatic leveling device of claim 1, wherein the sensor is an inclination sensor.

12. The automatic leveling device of claim 11, wherein the controller assembly includes control features that allow the user to set an angular range for the inclination sensor specifying a desired inclination for the surface of the load, and wherein, when the inclination sensor detects an inclination of the load surface outside of the set angular range, the controller assembly automatically changes the position of the bail assembly to bring the inclination of the load surface to within the set angular range.

13. The automatic leveling device of claim 12, wherein, after the inclination sensor detects an inclination of the load surface outside of the set angular range, the controller assembly is configured to wait for a predetermined time period before automatically causing a change in the position of the bail assembly.

14. The automatic leveling device of claim 13, wherein the predetermined time period is from five milliseconds to ten seconds.

15. The automatic leveling device of claim 12, wherein the controller assembly is configured to allow the user to specify a first angular range for a first desired orientation and to specify a second angular range, independent of the first angular range, for a second desired orientation, wherein the first desired orientation is defined by inclination in a first direction about a rotational axis, and the second desired orientation is defined by inclination in a second direction about the rotational axis, the second direction being opposite the first direction.

16. The automatic leveling device of claim 12, wherein the angular range is set in degrees with respect to horizontal.

17. The automatic leveling device of claim 11, wherein the controller assembly includes a plurality of inclination sensors arranged to detect a first inclination about a first rotational axis and a second inclination about a second rotational axis, the first rotational axis being perpendicular to the second rotational axis.

18. The automatic leveling device of claim 11, wherein the measurements of the plurality of inclination sensors are averaged, and wherein this average measurement is used by the controller assembly to determine where to position the slideable bail assembly.

19. A load-lifting apparatus comprising:

a lifting beam configured to be attached to a load; and an automatic leveling device attached to the lifting beam, the automatic leveling device comprising:

a motor mounted onto a frame;

a linear actuator coupled to the motor;

a slideable bail assembly coupled to the linear actuator, the bail assembly being attached to the frame; and a controller assembly having a sensor configured to determine an orientation of the attached load when the load is suspended, the controller assembly being configured to control the motor in order to position the slideable bail assembly such that the load is suspended in a user-defined predetermined orientation;

wherein the user-defined predetermined orientation may be at horizontal or at some angle with respect to horizontal.

20. The load-lifting apparatus of claim 19, wherein the bail assembly includes a device configured to receive a lifting hook of a crane, and wherein the lifting beam is attached to a surface of the load, and the controller assembly is configured to automatically position the bail assembly to keep the surface of the load oriented at a predetermined angle, with respect to horizontal, while the load is suspended.

21. The load-lifting apparatus of claim 19, wherein the controller assembly includes control features that allow the user to set an angular range for the sensor specifying a desired inclination for the surface of the load, and wherein, when the sensor detects an inclination of the load surface outside of the set angular range, the controller assembly automatically changes the position of the bail assembly to bring the inclination of the load surface to within the set angular range, the controller assembly being further configured to allow the user to specify a first angular range for a first desired orientation and to specify a second angular range, independent of the first angular range, for a second desired orientation, wherein the first desired orientation is defined by inclination in a first direction about a rotational axis, and the second desired orientation is defined by inclination in a second direction about the rotational axis, the second direction being opposite the first direction.

22. The load-lifting apparatus of claim 21, wherein, after the sensor detects an inclination of the load surface outside of the set angular range, the controller assembly is configured to wait for a predetermined time period before automatically causing a change in the position of the bail assembly.

23. The load-lifting apparatus of claim 21, further comprising one of a visual alarm and an audible alarm to indicate to the user whether or not the surface of the load is within the set angular range.

24. The load-lifting apparatus of claim 19, wherein the controller assembly includes a plurality of sensors arranged to detect a first inclination about a first rotational axis and a second inclination about a second rotational axis, the first rotational axis being perpendicular to the second rotational axis.

25. The load-lifting apparatus of claim 19, wherein the lifting beam is one of a cylinder lifting beam, a twin hoist lifting beam, an adjustable lifting beam, a spreader beam, a four-point beam, a rotating drum lifting beam, and a basket sling beam.

26. The load-lifting apparatus of claim 19, further comprising an overtravel limit switch configured to disable or limit movement of the linear actuator if the bail assembly moves to far towards or away from the linear actuator.

* * * * *